US008152458B2

(12) United States Patent
Buell et al.

(10) Patent No.: US 8,152,458 B2
(45) Date of Patent: Apr. 10, 2012

(54) CENTRIFUGAL PUMP WITH IMPROVED DRIVE SHAFT AND HEAT EXCHANGER

(75) Inventors: Steven E Buell, Sterling Hts., MI (US); David M DeClerck, Utica, MI (US)

(73) Assignee: MP Pumps, Inc., Fraser, MI (US)

( * ) Notice: Subject to any disclaimer, the term of this patent is extended or adjusted under 35 U.S.C. 154(b) by 455 days.

(21) Appl. No.: 12/431,248

(22) Filed: Apr. 28, 2009

(65) Prior Publication Data

US 2010/0272560 A1 Oct. 28, 2010

(51) Int. Cl.
*F01D 25/08* (2006.01)
*F04D 29/58* (2006.01)

(52) U.S. Cl. ..... 415/177; 415/116; 417/373; 417/366

(58) Field of Classification Search ..... 415/177, 415/178, 179, 180, 111, 116, 117; 417/366, 417/373

See application file for complete search history.

(56) References Cited

U.S. PATENT DOCUMENTS

| | | | | |
|---|---|---|---|---|
| 4,979,875 | A * | 12/1990 | Muller et al. | 415/168.1 |
| 5,195,867 | A * | 3/1993 | Stirling | 415/111 |
| 5,624,245 | A * | 4/1997 | DeClerck et al. | 417/373 |
| 5,911,565 | A * | 6/1999 | Mann et al. | 417/373 |
| 6,273,684 | B1 | 8/2001 | Jensen et al. | |
| 6,634,854 | B1 | 10/2003 | Albrecht et al. | |

* cited by examiner

*Primary Examiner* — David Nhu
(74) *Attorney, Agent, or Firm* — Woods Oviatt Gilman LLP; Katherine H. McGuire, Esq.

(57) ABSTRACT

A high temperature centrifugal pump includes non-linear fluid flow paths between the pump housing and seal housing to reduce fluid flow therebetween. In another aspect, the invention provides a drive shaft of variable diameter to compensate for different amounts of thermal expansion to maintain a more consistent gap profile between the drive shaft and thermal insulators or other components positioned around the drive shaft. In yet another aspect, a tube heat exchanger may be placed in fluid communication with the seal housing to re-circulate and cool the fluid therethrough.

35 Claims, 5 Drawing Sheets

CENTRIFUGAL PUMP WITH IMPROVED DRIVE SHAFT AND HEAT EXCHANGER

BACKGROUND OF THE INVENTION

The present invention generally relates to a high temperature centrifugal pump, and more particularly relates, in a first aspect thereof, to a pump having a drive shaft with a non-linear fluid channel designed to reduce the rate of fluid flow between the pump housing and the seal housing. In a second aspect thereof, the present invention relates to a thermally expandable drive shaft having a variable diameter designed to balance and compensate for different amounts of thermal expansion along its length. In yet a third aspect, the present invention relates to a tube heat exchanger operable to recirculate and cool fluid through the seal housing interior cavity.

The present invention provides improvements to the invention of commonly owned U.S. Pat. No. 5,624,245, the entire disclosure of which is incorporated herein by reference. Centrifugal pumps which operate at high temperatures (e.g., up to about and exceeding 400° F.) typically incorporate features designed to protect the motor and seals from the high temperature of the working fluid in the pump housing. FIG. 1 of the '245 patent is reproduced herein and is seen to include a pump housing 16 connected to a pump adapter casing which surrounds a seal housing 34 containing a mechanical seal 42 which prevents fluid from passing along drive shaft 28 toward the motor and fan 56. The drive shaft connects to an impeller 22 in pump housing 16 for directing fluid from pump inlet 24 to pump outlet 26. Thermal insulators 46 are mounted about the drive shaft between the pump housing and the seal housing to reduce heat transfer from the pump housing to the seal housing. An annular passage 54 allows working fluid to travel from the pump housing to the interior cavity of the seal housing to lubricate the seal during pump operation. To aid in dissipating heat from fluid within reservoir 40, the seal housing 34 includes external and internal fins 36, 38, respectively, to help draw heat away from the reservoir and into the interior cavity 62 of the pump adapter casing 12. The interior cavity 62 is vented to the ambient through one or more holes 64 to allow the escape of heated air.

While the invention of the '245 patent is effective at providing a good degree of thermal protection to the mechanical seal, some heat still reaches the mechanical seal due to the necessary lubricating fluid delivered via passage 54. Although, as noted in the '245 patent, little liquid circulates through passage 54 after pump startup (see Col. 3, Lns. 61-67), the liquid coming from the pump housing is very hot and it would therefore be desirable to further minimize and/or reduce the velocity of the free fluid transfer between the pump housing and seal housing as much as possible. It would furthermore be desirable to carry away a higher percentage of heat from seal reservoir 40 to further protect the mechanical seal from heat damage.

SUMMARY OF THE INVENTION

The present invention addresses the above needs by providing, in a first aspect thereof a non-linear or variable diameter fluid path between the pump housing and the seal housing. In one embodiment, a variable diameter fluid path is created by providing one or more enlarged annular fluid channels along the fluid path. The enlarged fluid channels may be formed by areas of reduced diameter on either or both of the facing surfaces of the drive shaft and thermal insulators or other component defining the fluid path from the pump housing to the seal housing. The annular fluid channels operate to allow the fluid to pool in the channels which creates turbulence in the fluid path between the pump housing and seal housing. As such, movement of fluid through the fluid path is reduced as compared to a fluid path that is of constant width along a linear path.

In a second aspect, which may be used separately or in combination with the first aspect of the invention described above, a variable diameter drive shaft is provided to compensate for differing amounts of thermal expansion along the length of the drive shaft. As discussed above, a fluid path or "gap" is formed between the facing surfaces of the drive shaft and thermal insulators (or other components in facing relation to the drive shaft). Other than at the enlarged areas for reducing fluid flow described above, it is generally desirable to minimize the gap as much as possible while still allowing the drive shaft to freely rotate with respect to the rotationally fixed thermal insulators. The end of the drive shaft closest to the pump housing will undergo a larger amount of thermal expansion than the end nearest the motor. As such, a thermal gradient develops along the length of the drive shaft which affects the amount of thermal expansion in a like manner. In prior art drive shaft designs of constant diameter, this thermal expansion gradient created a variable and hence out of specification gap along its length. The present invention provides a variable diameter drive shaft which increases in diameter toward the cool end of the shaft to balance and compensate for the higher thermal gradient near the hot end of the drive shaft.

In a third aspect of the invention, which may be used in combination with or separately of the first and second aspects described above, a tube heat exchanger is provided in fluid communication with the seal housing interior reservoir. In one embodiment, the heat exchanger is a coil type heat exchanger having inlet and outlet ends connected to the seal housing with the coil extending exteriorly of the seal housing. Lubricating fluid in the seal housing reservoir is directed into the inlet end of the heat exchanger, travels and in the process cools through the coil, and then returns to the seal housing reservoir through the outlet end of the heat exchanger. As such, the lubricating fluid is being constantly recirculated and cooled through the seal housing reservoir, thus increasing the amount of heat carried away from the lubricating fluid which even further protects the mechanical seal from heat damage. The coil may be advantageously placed adjacent the fan located between the motor and seal housing.

DETAILED DESCRIPTION OF PREFERRED EMBODIMENTS

Figure 2:
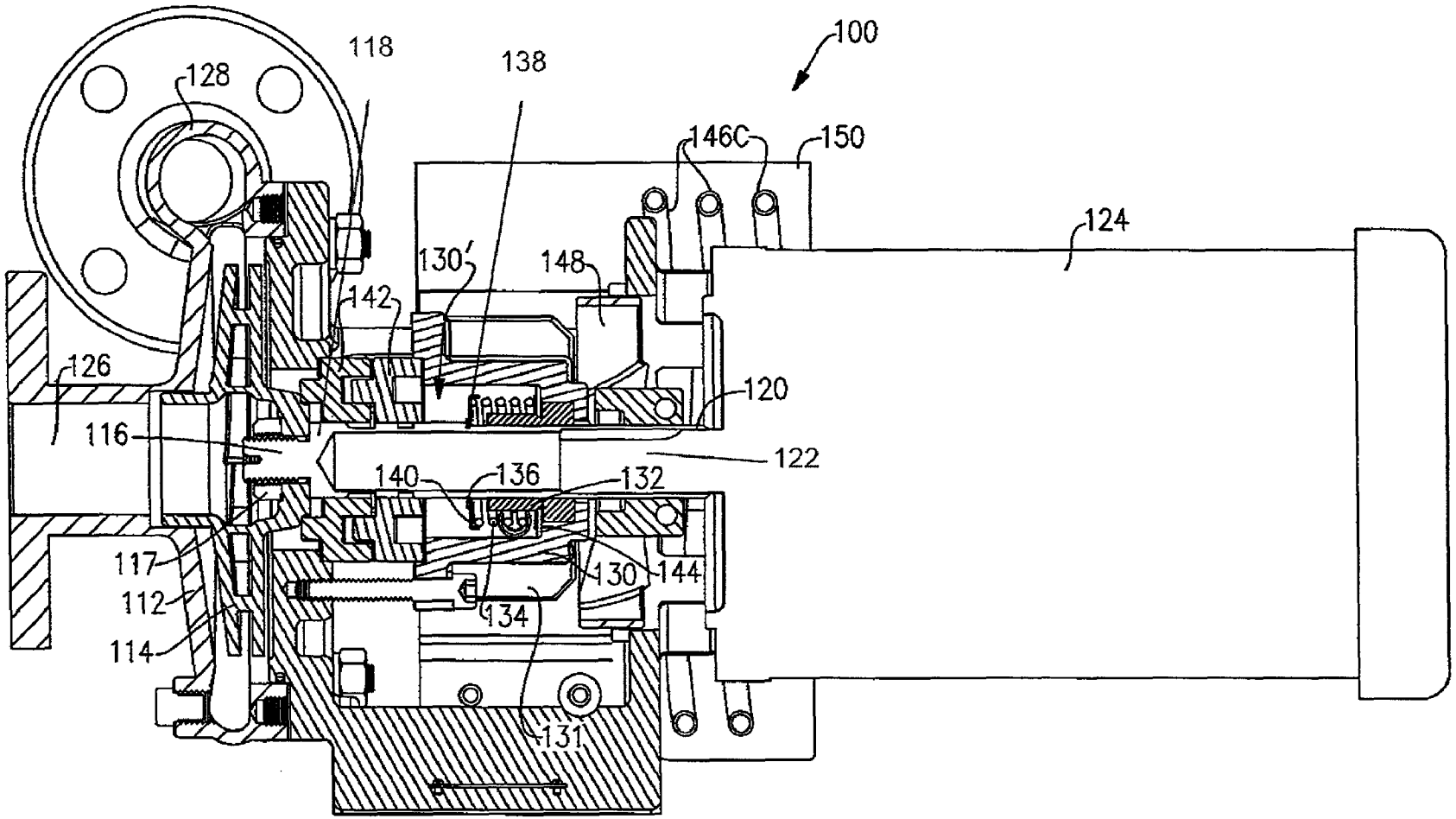
FIG. 2 is a cross-sectional view of an embodiment of the present invention.

Referring now to the drawing, there is seen in FIG. 2 an embodiment of a high temperature centrifugal pump 100 having a pump housing 112 in which is contained an impeller 114 to which a first threaded end 116 of a drive shaft 118 attaches via lock nut 117, the opposite shaft end 120 attaching to the drive output 122 of a motor 124. To reduce heat transfer along the drive shaft, in a preferred embodiment, drive shaft 118 is in the form of a hollow sleeve as shown with output shaft 122 telescoping into sleeve 118. Motor 124 is operable to rotate drive shaft 118 and impeller 114 to pump a working fluid from pump inlet 126 to pump outlet 128.

A seal housing 130 is provided which surrounds a mechanical seal 132 mounted on shaft 118 to prevent working fluid from reaching motor 124. In a preferred embodiment, seal 132 is spring loaded with a spring 134 applying a biasing force toward motor 124. A snap ring 136 may be fitted to an annular groove 138 formed in drive shaft 118 (see also FIG. 3) to fix first spring end plate 140 in place. Spring seat 144 may freely translate axially along the neck of seal 132 with spring 134 biasing seat 144 against the shoulder of the seal 132 to form a tight seal between seal housing 130 and drive shaft 118. As more fully explained below, a fluid path is provided between pump housing 112 and seal housing 130 with fluid collecting in seal housing reservoir 130' to lubricate seal 132.

One or more thermal insulators 142 as described in the '245 patent may be provided to extend about drive shaft 118 adjacent end 116 thereof to provide thermal insulation between pump housing 114 and seal housing 132. As seen best in FIG. 2*a*, the inner diameter surface 142*a* is in close, facing relation to drive shaft cylindrical surface 118*a*, forming a small gap G therebetween wherethrough fluid may flow from pump housing 114 to seal housing reservoir 130' along the fluid path indicated by the arrows labeled FP.

Figure 1:
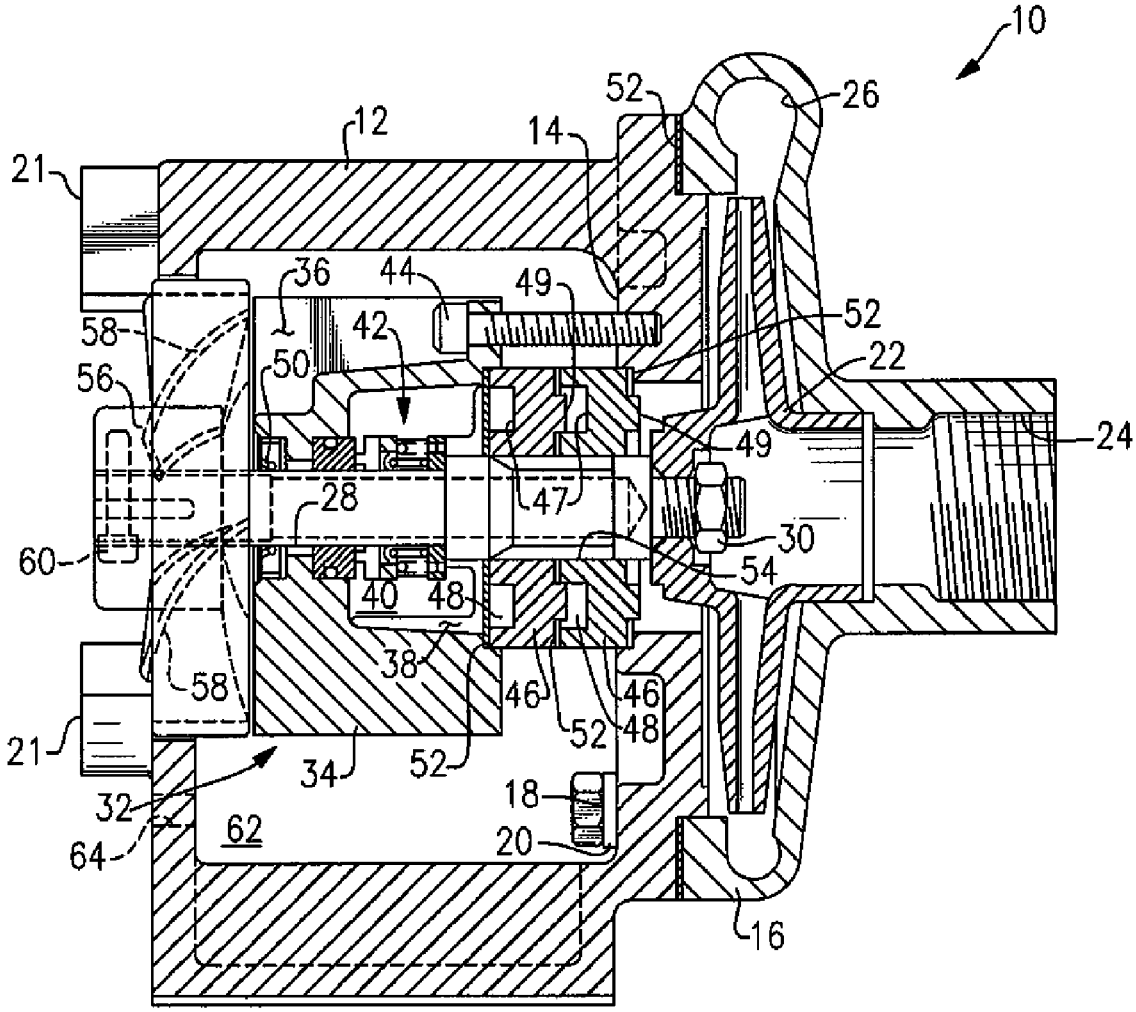
FIG.1 Prior Art
FIG. 1 is a cross-sectional view of the prior art pump depicted in FIG. 1 of commonly owned U.S. Pat. No. 5,624,245.

As seen in prior art FIG. 1, the fluid path 54 formed an essentially linear fluid path between the facing surfaces of the insulators 46 and drive shaft 28, As such, fluid easily flows between pump housing 16 and seal housing reservoir 40 and is an added source of heat transfer between the pump and seal housings. Rather than the linear fluid path of the prior art, the present invention provides a non-linear fluid path FP to slow down the flow of fluid (and hence the amount of heat transfer) between the pump and seal housings.

Figure 2A:
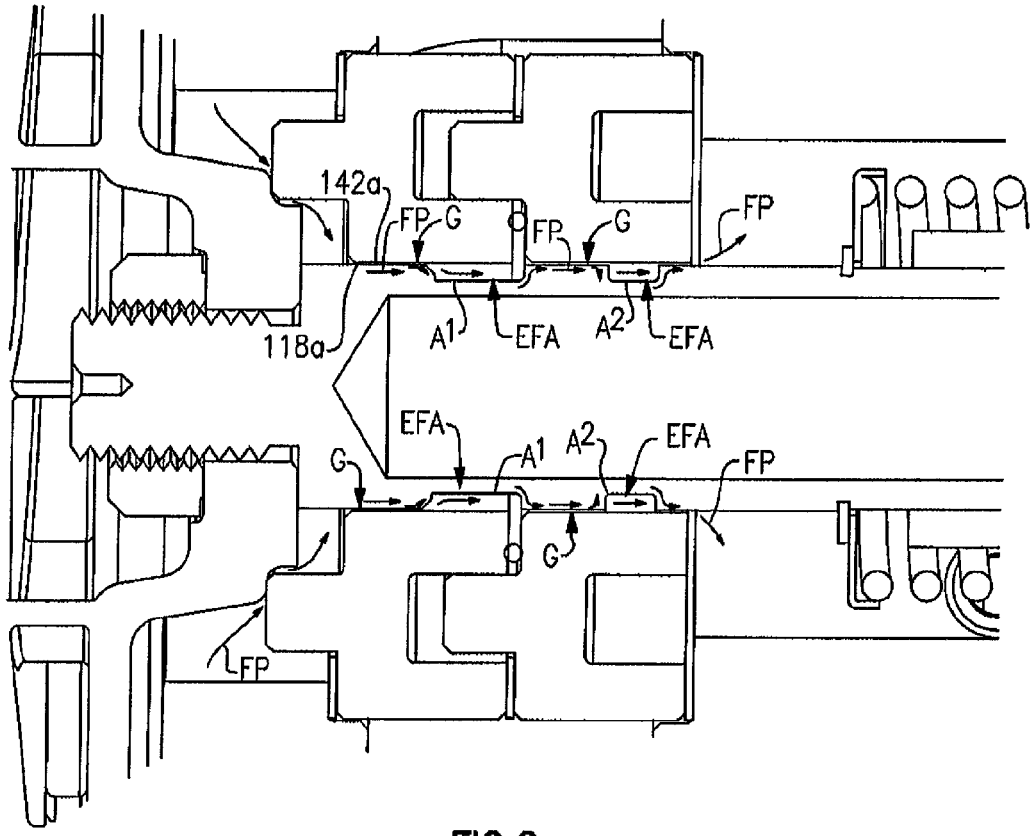
FIG. 2*a* is an enlarged view of the detail circle seen in FIG. 2.
Figure 3:
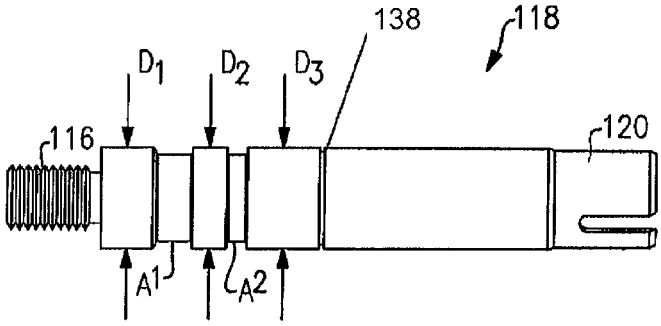
FIG. 3 is a side elevational view of an embodiment of the drive shaft of the present invention.

Non-linear flow paths may be formed in a variety of configurations, for example, geometries designed to create one or more areas of turbulence within the path which act to slow down the flow of fluid. Referring to FIGS. 2*a* and 3, one possible configuration of a non-linear fluid path FP is created by providing first and second areas of reduced diameter $A^1$ and $A^2$ on drive shaft 118. Areas $A^1$ and $A^2$ extend in longitudinally spaced relation on drive shaft 118 and face inner diameter surface 142*a* of thermal insulators together defining non-linear flow path FP. The areas of reduced diameter $A^1$ and $A^2$ create enlarged fluid areas EFA which allow the fluid to pool and undergo turbulence in these areas, thus slowing down the advance of fluid from the pump housing toward the seal housing.

FIGS. 4*a*-4*f* illustrate other possible configurations of a non-linear flow path although it will be understood to those skilled in the art that further configurations are possible and the invention is thus not to be limited thereby. Also, although not shown in FIGS. 4*a-f*, it is understood the flow paths are created between the spaced, facing surfaces of the drive shaft and insulators (or other component) which are each configured to achieve the desired path flow profile.

Figure 4A:
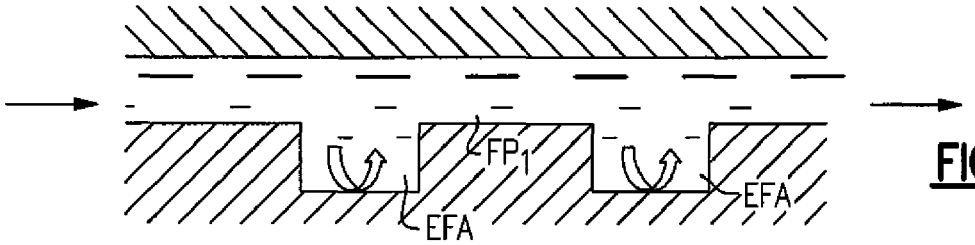
FIGS. 4*a*-4*f* are diagrammatic representations of a variety of possible fluid path profiles.

FIG. 4*a* illustrates a non-linear flow path $FP_1$ having one or more enlarged fluid areas EFA located on the same side of the fluid path.

Figure 4B:
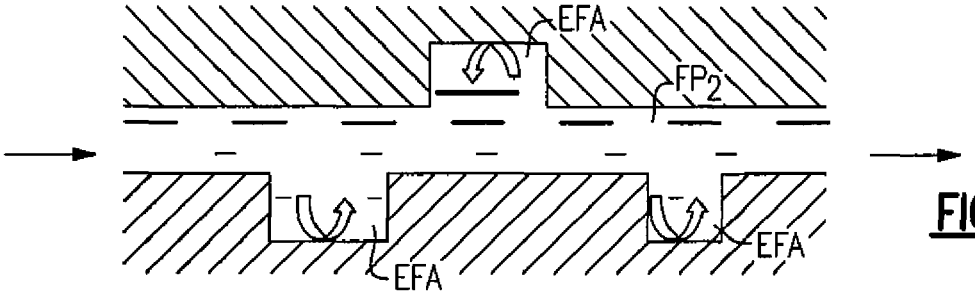

FIG. 4*b* illustrates a non-linear flow path $FP_2$ having one or more enlarged fluid areas EFA located on opposite sides of the fluid path.

Figure 4C:
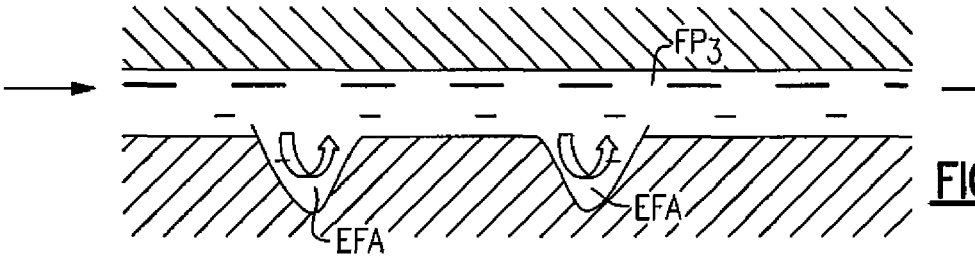

FIG. 4*c* illustrates a non-linear flow path $FP_3$ having one or more enlarged fluid areas EFA which are curved and located on the same side of the fluid path.

Figure 4D:
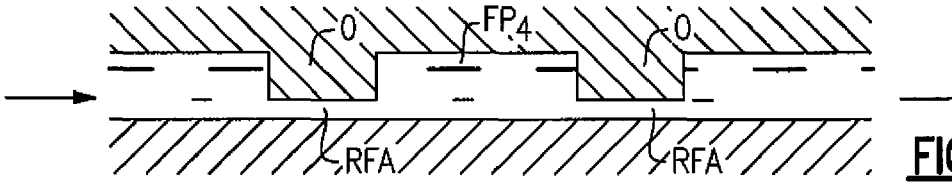

FIG. 4*d* illustrates a non-linear flow path $FP_4$ having one or more reduced fluid areas RFA created by one or more obstructions O located on the same side of the fluid path. The obstructions O may be created by elements integral or separate to the drive shaft and insulators or other components.

Figure 4E:
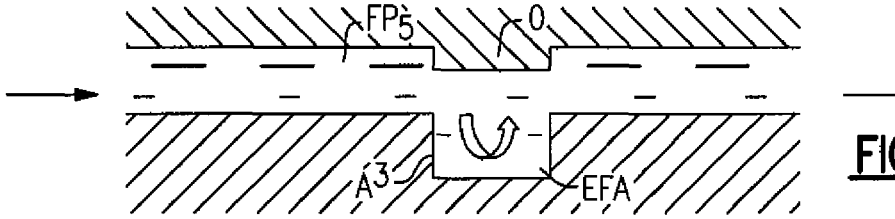

FIG. 4*e* illustrates a non-linear flow path $FP_5$ having one or more enlarged fluid areas EFA created by both an obstruction O and an area of reduced diameter $A^3$.

Figure 4F:
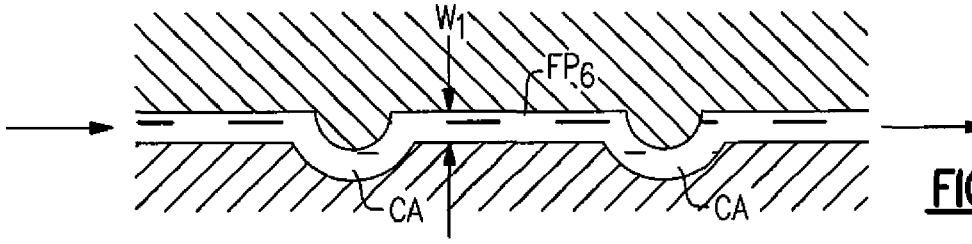

FIG. 4*f* illustrates a non-linear flow path $FP_6$ having one or more curved areas CA and may or may not be of constant width $W_1$ throughout the length of the flow path.

Referring again to FIGS. 2*a* and 3, since drive shaft 118 must be able to freely rotate with respect to rotationally fixed insulators 142, a gap G exists between their facing surfaces (which also forms the fluid path as described above). Thus, while gap G is necessary, it is generally desirable to maintain gap G to a very small width regardless of the presence or absence of enlarged or reduced fluid areas designed to slow the fluid flow as described above. Drive shaft 118 may be formed of a thermally expandable material and, as such, will expand more in the area near end 116 which is closest to hot pump housing 112, and less in the area near end 120 which is closest to cooler motor 124. In prior art embodiments where the drive shaft is of constant diameter, the difference in thermal expansion along the length of the shaft can cause unequal gap widths leading to an inconsistent and out of specification gap dimension profile along the shaft length during pump operation. To address this problem with prior art drive shafts, the present invention provides a drive shaft having a variable diameter longitudinal section such as at $D_1$, $D_2$ and $D_3$ (see FIG. 3) with the shaft diameter gradually increasing in the direction toward cool end 120 whereby $D_1<D_2<D_3$, During pump operation, the shaft temperature gradient will start and be highest adjacent hot end 116 and gradually lower in the direction of cool end 120. As such, thermal expansion will be greatest at diameter $D_1$ and lower at diameter $D_2$ and yet still lower at diameter $D_3$. By making $D_1<D_2<D_3$, the differences in thermal expansion are compensated for whereby upon full thermal expansion of the drive shaft, the variable diameter longitudinal section becomes substantially equal in diameter resulting in a uniform gap profile G.

Figure 5:
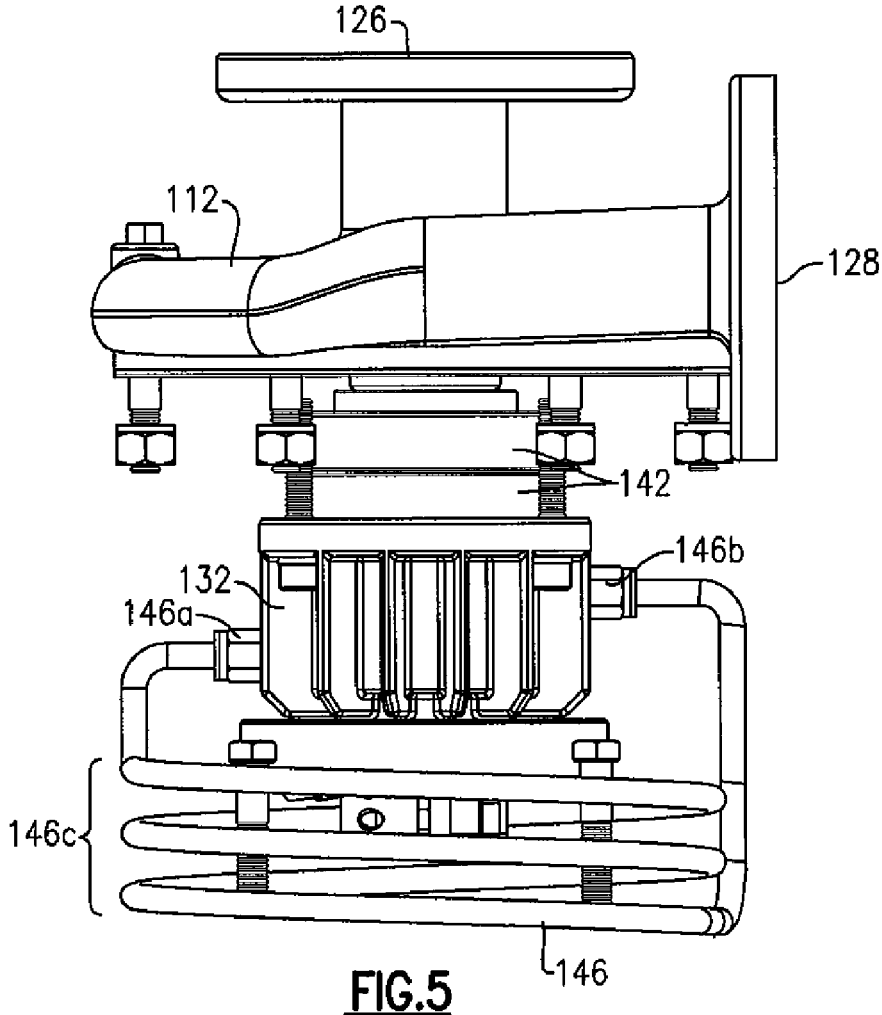
FIG. 5 is an elevational view of certain components of the pump of FIG. 2 to better illustrate the tube heat exchanger connection to the seal housing.
Figure 6:
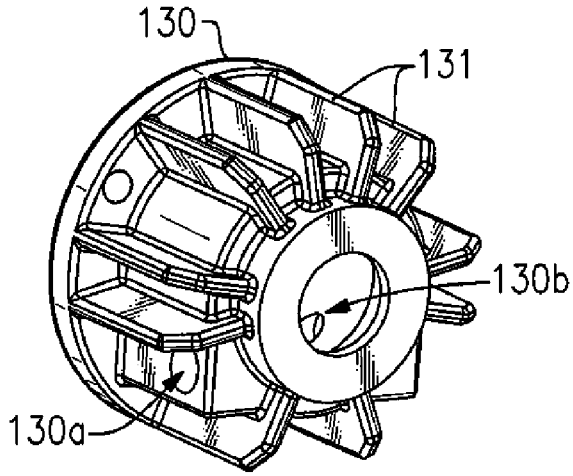
FIG. 6 is a perspective view of the seal housing.

Referring to FIGS. 2, 5 and 6, as in the '245 patent, seal housing 130 may include a plurality of radially extending fins 131 to carry heat away from seal housing reservoir 130'. To even further aid in cooling of seal housing 130, a tube heat exchanger 146 may be provided to constantly re-circulate fluid through reservoir 130'. In the embodiment illustrated in the Figures, heat exchanger 146 is a coil type heat exchanger having an inlet end 146*a* and outlet end 146*b* which are attached to respective through holes 130*a* and 130*b* formed in seal housing 130 (see FIG. 6). Fluid in reservoir 130' enters the heat exchanger 146 at inlet end 146*a*, circulates and cools through coils 146*c*, and returns to reservoir 130' through outlet end 146*b*. As seen in FIG. 5, inlet end 146*a* may be axially spaced from outlet end 146*b* in a direction toward motor 124 which assists in the re-circulating flow of fluid through reservoir 130' and heat exchanger 146.

A cooling fan 148 may be provided as seen in FIG. 2 to assist in cooling seal housing 130. Heat exchanger 146 may be strategically positioned with respect to fan 148 to benefit from the air currents created by fan 148. In the embodiment of FIG. 2, heat exchanger coils 146 are positioned radially outwardly of and span the area between fan 148 and motor 124. A shield 150 may also be provided if desired.

While the present invention has been described with respect to preferred embodiments thereof, it is understood that variations will be apparent to those skilled in the art and the invention is not to be limited thereby but rather by the full spirit and scope of the claims which follow. For example, although the invention has been described in the context of a high temperature centrifugal pump, it is envisioned the advantages afforded by the various aspects of the invention may have applicability to other applications where heat transfer control is an issue.

What is claimed is:

1. A high temperature liquid pump comprising:

a) a pump housing;

b) an impeller rotatably disposed within said pump housing;

c) a drive shaft connected to said impeller;

d) a seal housing having an interior cavity surrounding a mechanical seal located about said drive shaft, said seal housing spaced apart from said pump housing; and e) a tube heat exchanger in fluid communication with said seal housing interior cavity and including a portion thereof located exteriorly of said seal housing, said tube heat exchanger operable to carry heat away from said seal housing interior cavity.

2. The high temperature liquid pump of claim 1, wherein said tube heat exchanger is a coil type heat exchanger having an inlet end and an outlet end each in fluid communication with said seal housing interior cavity and operable to continuously circulate fluid through said seal housing interior cavity and said heat exchanger coil.

3. The high temperature liquid pump of claim 2 wherein said inlet end and said outlet end are axially spaced from each other relative to the axis along which said drive shaft extends.

4. The high temperature liquid pump of claim 2 and further comprising a fan directed to circulate air about said heat exchanger coil.

5. The high temperature liquid pump of claim 4 wherein at least a portion of said coil extends in radially outwardly and longitudinally spaced relation to said fan.

6. The high temperature liquid pump of claim 5 wherein said fan is mounted to said drive shaft on the side of said mechanical seal opposite said pump housing.

7. The high temperature liquid pump of claim 1 wherein said seal housing includes an outer surface having a plurality of fins extending outwardly therefrom and operable to transfer heat away from said seal housing interior cavity.

8. The high temperature liquid pump of claim 1 and further comprising a thermal insulator disposed between said pump housing and said seal housing to reduce heat transfer from said pump housing to said seal housing.

9. The high temperature liquid pump of claim 8 wherein said thermal insulator comprises two or more elements axially juxtaposed to each other.

10. The high temperature liquid pump of claim 9 wherein said elements each include a protuberance on one side and a recess on an opposite side, said protuberance of one element interfitting into the recess of an axially juxtaposed element.

11. The high temperature liquid pump of claim 10 wherein said recess on one element and said protuberance on said juxtaposed element are spaced to define an air pocket therebetween and operable to decrease heat flow therethrough.

12. The high temperature liquid pump of claim 8 wherein said thermal insulator comprises a thermal conductivity of between about 5 and 9 BTU/hr ft ° F.

13. The high temperature liquid pump of claim 12 wherein said thermal conductivity is about 5 BTU/hr ft ° F.

14. The high temperature liquid pump of claim 1 wherein a portion of said pump housing surrounds said seal housing in radially spaced relation thereto to define an air cavity therebetween, said air cavity vented to ambient to carry heat away from said seal housing.

15. The high temperature liquid pump of claim 1 wherein said drive shaft includes first, second and third diameters with first and second recessed channels extending between said first and second diameters and said second and third diameters, respectively, said recessed channels forming axially spaced fluid channels providing a nonlinear, reduced velocity flow path between said pump housing and said seal housing interior cavity.

16. The high temperature liquid pump of claim 1 wherein said drive shaft is hollow and includes an end opposite said impeller adapted to connect to the output shaft of a motor.

17. A high temperature liquid pump comprising:

a) a pump housing;

b) an impeller rotatably disposed within said pump housing;

c) a drive shaft connected to said impeller, said drive shaft having first and second areas of reduced diameter forming respective first and second fluid channels in longitudinally spaced relation along said drive shaft;

d) a seal housing having an interior cavity surrounding a mechanical seal located about said drive shaft, said seal housing spaced apart from said pump housing; and e) a thermal insulator disposed between said pump housing and said seal housing and extending concentrically about said first and second fluid channels, said thermal insulator operable to reduce heat transfer from said pump housing to said seal housing, said first and second fluid channels providing a nonlinear, reduced velocity flow path between said pump housing and said seal housing interior cavity.

18. The high temperature liquid pump of claim 17 wherein said first fluid channel is defined between first and second diameters of said drive shaft, and said second fluid channel is defined between said second diameter and a third diameter of said drive shaft, said first diameter being smaller than said second diameter and said drive shaft being formed of a thermally expandable material, said first diameter located closer to said pump housing than said second diameter and thereby undergoes a larger thermal expansion than said second diameter during pump operation, said thermal expansion causing a reduction in the spacing between said thermal insulator and said drive shaft first diameter.

19. The high temperature liquid pump of claim 18 wherein said third diameter is smaller than said second diameter, said second diameter located closer to said pump housing than said third diameter and thereby undergoes a larger thermal expansion than said third diameter during pump operation, said thermal expansion causing a reduction in the spacing between said thermal insulator and said drive shaft second diameter.

20. The high temperature liquid pump of claim 17 and further comprising a tube heat exchanger in fluid communication with said seal housing interior cavity and including a portion thereof located exteriorly of said seal housing interior cavity, said tube heat exchanger operable to carry heat away from said seal housing interior cavity.

21. The high temperature liquid pump of claim 20, wherein said heat exchanger is a coil type heat exchanger having an inlet end and an outlet end each in fluid communication with said seal housing interior cavity and operable to continuously circulate fluid through said seal housing interior cavity and said heat exchanger coil.

22. The high temperature liquid pump of claim 21 wherein said inlet end and said outlet end are axially spaced from each other relative to the axis along which said drive shaft extends.

23. The high temperature liquid pump of claim 21 and further comprising a fan directed to circulate air about said heat exchanger coil.

24. The high temperature liquid pump of claim 23 wherein at least a portion of said coil extends in radially outwardly and longitudinally spaced relation to said fan.

25. The high temperature liquid pump of claim 23 wherein said fan is mounted to said drive shaft on the side of said mechanical seal opposite said pump housing.

26. The high temperature liquid pump of claim 21 wherein said seal housing includes an outer surface having a plurality of fins extending outwardly therefrom and operable to transfer heat away from said seal housing interior cavity.

27. A high temperature liquid pump comprising:

a) a pump housing;

b) an impeller rotatably disposed within said pump housing;

c) a drive shaft connected to said impeller, said drive shaft being formed from a thermally expandable material, said drive shaft having a variable diameter longitudinal section which decreases toward said impeller whereby upon full thermal expansion of said drive shaft, said variable diameter longitudinal section becomes substantially equal in diameter.

28. The high temperature liquid pump of claim 27 and further comprising a seal housing having an interior cavity surrounding a mechanical seal located about said drive shaft, said seal housing spaced apart from said pump housing.

29. The high temperature liquid pump of claim 27, and further comprising:

d) said drive shaft having first and second areas of reduced diameter forming respective first and second fluid channels in longitudinally spaced relation along said drive shaft;

e) a seal housing having an interior cavity surrounding a mechanical seal located about said drive shaft, said seal housing spaced apart from said pump housing; and f) a thermal insulator disposed between said pump housing and said seal housing and extending concentrically about said fluid channels, said thermal insulator operable to reduce heat transfer from said pump housing to said seal housing, said fluid channels providing a non-linear, reduced velocity flow path between said pump housing and said seal housing interior cavity.

30. The high temperature liquid pump of claim 29, and further comprising a tube heat exchanger in fluid communication with said seal housing interior cavity and including a portion thereof located exteriorly of said seal housing, said heat exchanger operable to carry heat away from said seal housing interior cavity.

31. The high temperature liquid pump of claim 30, wherein said heat exchanger is a coil type heat exchanger having an inlet end and an outlet end each in fluid communication with said seal housing interior cavity and operable to continuously circulate fluid through said seal housing interior cavity and said heat exchanger coil.

32. The high temperature liquid pump of claim 31 wherein said inlet end and said outlet end are axially spaced from each other relative to the axis along which said drive shaft extends.

33. The high temperature liquid pump of claim 31 and further comprising a fan directed to circulate air about said heat exchanger coil.

34. The high temperature liquid pump of claim 33 wherein at least a portion of said coil extends in radially outwardly and longitudinally spaced relation to said fan.

35. The high temperature liquid pump of claim 34 wherein said fan is mounted to said drive shaft on the side of said mechanical seal opposite said pump housing.

* * * * *